US010905293B2

(12) United States Patent
Cohen et al.

(10) Patent No.: US 10,905,293 B2
(45) Date of Patent: Feb. 2, 2021

(54) CONVERTIBLE DISPENSER

(71) Applicants: Steven Cohen, Northlake, TX (US); Andrew George Avinger, III, Flower Mound, TX (US)

(72) Inventors: Steven Cohen, Northlake, TX (US); Andrew George Avinger, III, Flower Mound, TX (US)

( * ) Notice: Subject to any disclaimer, the term of this patent is extended or adjusted under 35 U.S.C. 154(b) by 0 days.

(21) Appl. No.: 16/667,481

(22) Filed: Oct. 29, 2019

(65) Prior Publication Data

US 2020/0138250 A1 May 7, 2020

Related U.S. Application Data

(60) Provisional application No. 62/751,956, filed on Oct. 29, 2018.

(51) Int. Cl.
*A47K 10/38* (2006.01)

(52) U.S. Cl.
CPC .... *A47K 10/3836* (2013.01); *A47K 2010/389* (2013.01)

(58) Field of Classification Search
CPC ..... A47K 10/38; A47K 10/3836; A47K 2010/389
See application file for complete search history.

(56) References Cited

U.S. PATENT DOCUMENTS 2,523,951 A * 9/1950 Graumlich ..... A47K 10/3836 242/423.1
2,661,165 A * 12/1953 Salmonson ..... A47K 10/3836 242/422.5
3,227,386 A * 1/1966 Pitcher ..... A47K 10/3836 242/597.5
3,370,805 A * 2/1968 Barbee ..... A47K 10/3836 242/594.3
4,241,885 A * 12/1980 Robinson ..... A47K 10/38 242/591
4,741,486 A * 5/1988 Ancona ..... A47K 10/3836 242/597.4
5,311,729 A * 5/1994 Viaud ..... A01F 15/0715 100/88
5,690,302 A * 11/1997 Batts ..... A47K 10/38 242/591
5,762,285 A * 6/1998 Lin ..... A47K 10/3836 242/565
5,913,491 A * 6/1999 Bulla ..... A47K 10/3836 242/597
6,786,377 B1 * 9/2004 Holden ..... B65H 35/10 225/106
7,306,185 B1 * 12/2007 Miller ..... A47K 10/3836 242/592
9,480,371 B2 * 11/2016 Lowe ..... A47K 10/38
9,869,424 B1 * 1/2018 Forrest ..... A47H 1/022
(Continued)

*Primary Examiner* — William A. Rivera
(74) *Attorney, Agent, or Firm* — Braxton Perrone, PLLC; Bobby W. Braxton; Gregory Perrone

(57) ABSTRACT

A system and method for dispensing toilet paper. The system includes a back plate coupled to a cover. An arm base is coupled to an arm, and the arm is coupled to a post. The arm base can rotate relative to the cover. By applying a force the arm rest can unseat and freely rotate. If the user starts with an over-the-top roll configuration the user can rotate the arm to present a behind-the-roll configuration without any need for tools or disassembly.

14 Claims, 9 Drawing Sheets

(56) References Cited

U.S. PATENT DOCUMENTS

| | | | | |
|---|---|---|---|---|
| 10,398,263 | B2 * | 9/2019 | Goodman | A47K 10/3836 |
| 2014/0332619 | A1 * | 11/2014 | Yang | A47K 10/10<br>242/597.8 |

* cited by examiner

CONVERTIBLE DISPENSER

PRIORITY

The present invention claims priority to U.S. Provisional No. 62/751,956, the entirety of which is hereby incorporated by reference.

BACKGROUND OF THE INVENTION

Technical Field

The present invention relates to a system and method for a convertible dispenser.

Description of Related Art

Toilet paper is typically displayed and housed adjacent to a toilet. However, the current system and method for dispensing the toilet paper has many downsides. Consequently, there is a need for an improved system and method for dispensing toilet paper.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Toilet paper dispensers are often stored adjacent to a toilet. These have many disadvantages. First, the toilet paper holder often is supported at both ends. Thus, the user must manipulate two ends to install a new roll of toilet paper and remove a spent roll.

Second, there is much angst over which is the correct way to install a new roll of toilet paper. Some people prefer the method wherein the free end is laid over the top front of the roll, referred to as the over-the-top configuration, whereas others prefer that the free end be behind and under the roll, referred to as the behind-the-roll configuration. The prior art dispensers required significant manipulation thus when a roll was installed in a certain way, it was often left for the remainder of the roll. Consequently, discussed herein is a system and method which allows for simpler installation and removable of spent toilet paper rolls.

It should be noted that while one embodiment discusses toilet paper rolls, this is for illustrative purposes only and should not be deemed limiting. Any item which is dispensed on a roll can be utilized in the system and method discussed herein. This includes paper towels, foil, etc.

Figure 1:
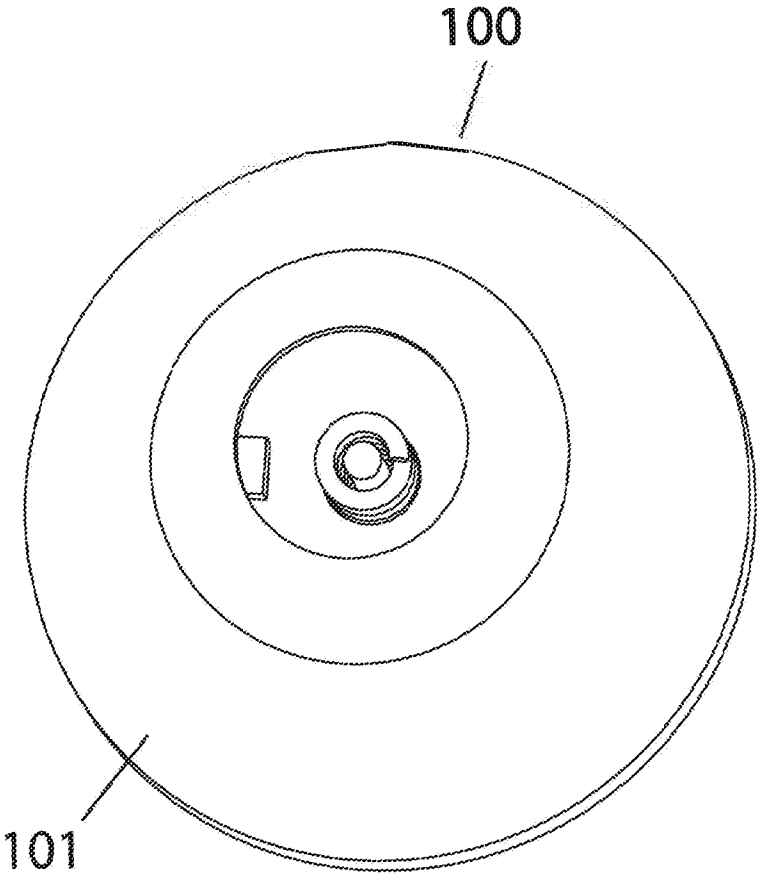
FIG. 1 is a front perspective view of the dispensing device in one embodiment.

FIG. 1 is a front perspective view of the dispensing device in one embodiment. FIG. 1 shows the dispensing device 100. Not depicted is the post, which will be discussed in reference to FIG. 4, below.

The dispensing device 100 can comprise virtually any material, including, but not limited to, plastic, metal, rubber, wood, and combinations thereof.

As shown the dispensing device 100 comprises a cover 101. The optional cover 101 covers and hides the mechanized features of the dispensing device 100. The cover 101 provides an elegant appearance.

Figure 2:
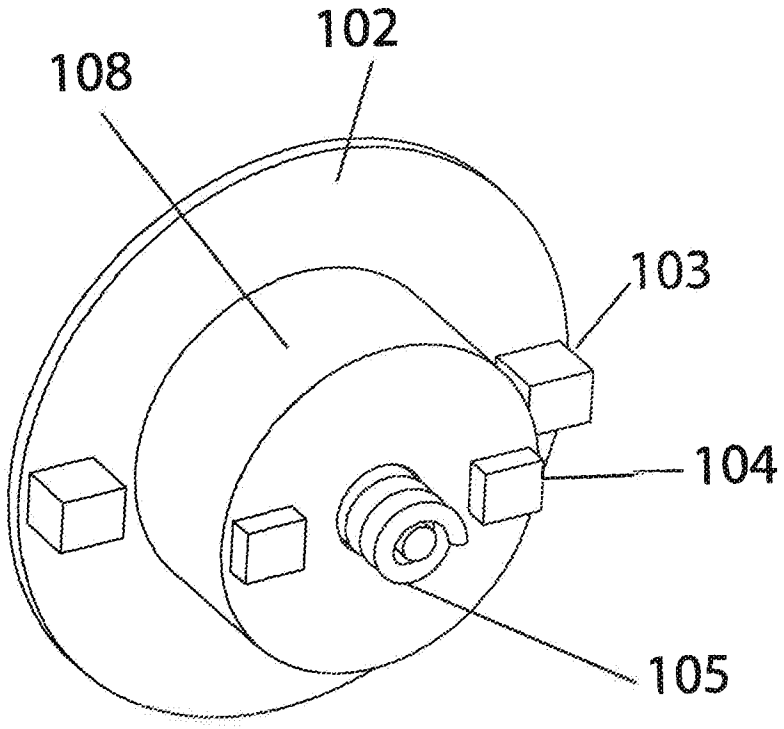
FIG. 2 is a front perspective view of a back plate in one embodiment.

FIG. 2 is a front perspective view of a back plate in one embodiment. As noted above, the back plate 102 can comprise virtually any material. In one embodiment the back plate 102 comprises set screws 103 which are used to secure the back plate 102 to the wall. The set screws 103 can also be used to couple the cover 101 to the back plate 102. Virtually any device or method for coupling the dispensing device 100 to a wall can be utilized.

The back plate 102, as depicted, comprises a flat rear panel. This panel is laid flush against a wall and secured to the wall via the set screws 103 or other method. While the panel is depicted as planar, in other embodiments the panel will comprise a bent or angular section to allow for installation in corners, for example.

The panel is depicted as being circular. This is for illustrative purposes only and should not be deemed limiting.

The back plate 102 further comprises an extension 108. In one embodiment the extension 108 is hollow and comprises a recess. The extension 108 houses an optional spring 105. The spring 105 is coupled to a post, not shown in FIG. 2. The spring 105 can provide tension to couple to the post and lock the post in the desired location.

In another embodiment a tension device such as a separate friction spring can be used to add friction to the roll and prevent the roll from accidentally deploying a fully unrolled roll. Sometimes the free end is pulled too quickly which allows the roll to freely spin, deploying many undesired lengths of toilet paper. This tension prevents this from happening.

Additionally, the dispensing device can further comprise a bearing, or ratcheting system, or the like which can supply friction to prevent unraveling of the toilet paper roll.

Figure 3:
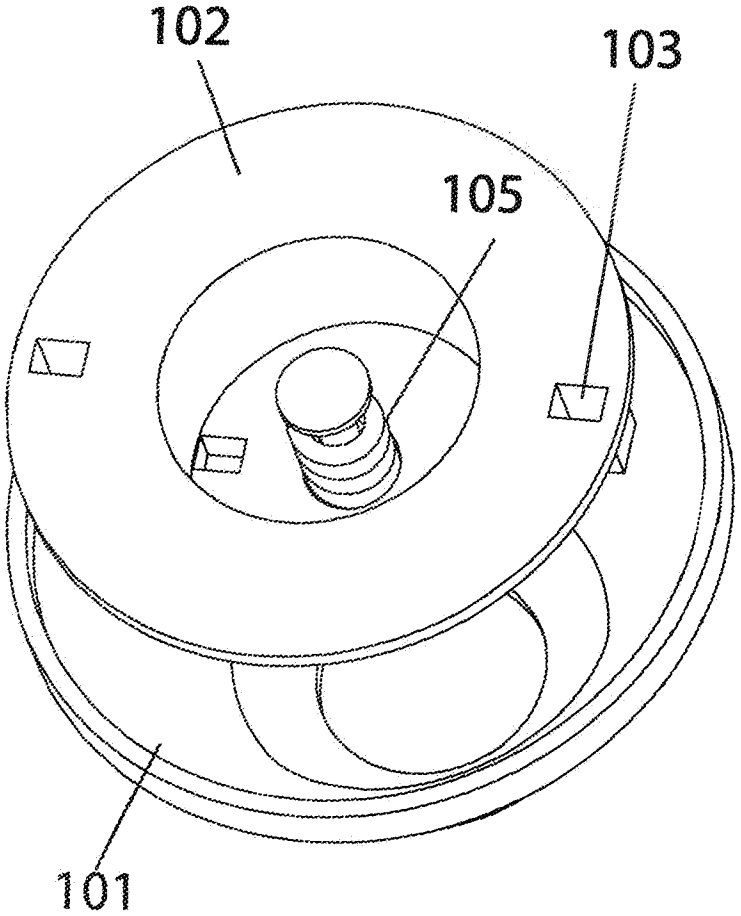
FIG. 3 is a back-perspective view of a dispensing device in one embodiment.

FIG. 3 is a back-perspective view of a dispensing device in one embodiment. As can be seen, the back plate 102 is coupled to the cover 101. The recess is behind the extension 108 and provides real estate for the spring 105.

Figure 4:
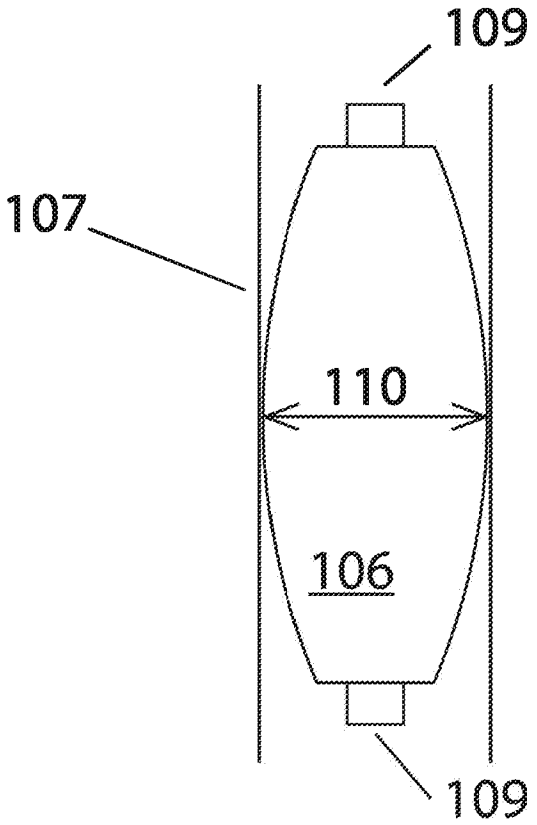
FIG. 4 is a cross-section of the post coupled to a roll in one embodiment.

FIG. 4 is a cross-section of the post coupled to a roll in one embodiment. The post 106 can comprise virtually any shape. In one embodiment the post is tapered as to have a maximum outer diameter 110. In one embodiment the maximum outer diameter 110 is located at the center of the length.

In one embodiment the maximum outer diameter 110 is sized such that it offers tension against the tube 107 of the roll. Typically toilet paper rolls are rolled around an internal card board roll, the tube 107. By sizing the maximum outer diameter 110 of the post 106 to be snug against the tube 107, the tube 107, and thus the roll, is coupled to the post 106 via friction fit.

This snug arrangement keeps the roll in place when the post 106 is removed from the displacing device 100. This, in combination with the friction bearing/ratcheting system prevents accidental unraveling of the roll during the transition, installation, or removal of the roll.

The post 106 can comprise virtually any material. As shown, the post has two couplers 109 at each end. In one embodiment the couplers 109 are adapted to be coupled to the back plate 102. In one embodiment the couplers 109 are adapted to be coupled to the spring 105.

In one embodiment only a single couple 109 is coupled to the back plate 102. The other opposing coupler 109 is not engaged and is instead a free coupler. In this fashion, a user can install the roll to a first coupler 109 and allow for an over dispensing position. The user can then decouple the first coupler 109, rotate the post 106, and couple the second opposing coupler 109. This will then allow for the under dispensing position.

As noted, in one embodiment coupling and decoupling the post 106 to the back plate 102 requires no additional tools or screws. Further, in one device, only a single end of the post needs to be coupled to decoupled. This is an advantage because it allows the post to be quickly coupled or decoupled, often with a single hand.

In one embodiment the couplers 109 extend beyond the length of the tube 107, as depicted. In other embodiments, however, the couplers 109 do not extend beyond the length of the tube 107.

Figure 5:
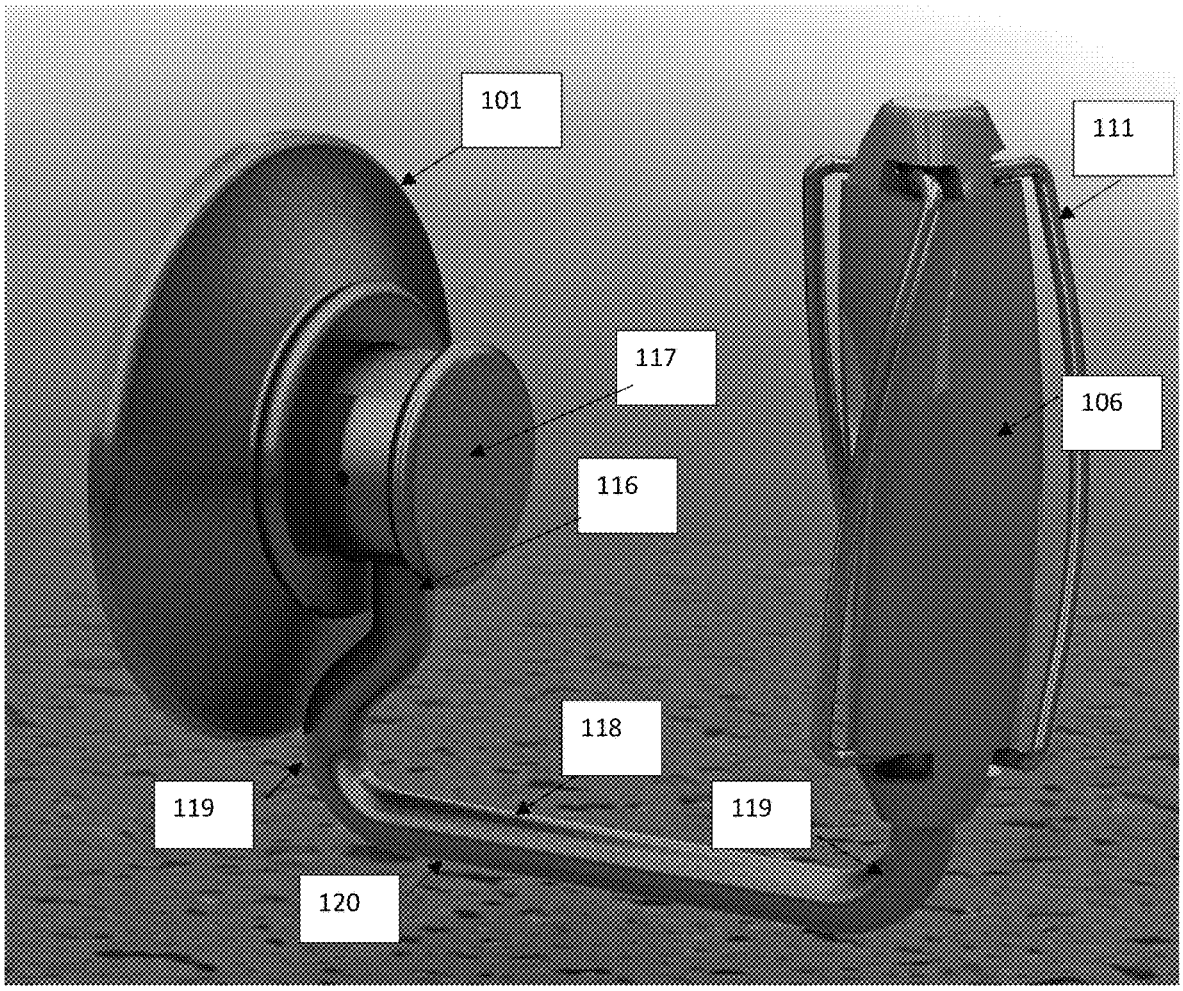
FIG. 5 is a perspective of the dispensing device in one embodiment with an arm.

Turning now to FIG. 5, FIG. 5 is a perspective of the dispensing device in one embodiment with an arm. In this embodiment the post 106 is coupled to said cover 101 and the back plate 102 via an arm 118. The arm 118 can comprise the same or different materials as the cover 101 and back plate 102.

As shown the arm extends outward from the arm base 116. As depicted the arm 118 includes two ninety degree bends 119 such that the post 106 is parallel with the cover 101. The arm 118 has a middle portion referred to as the separator arm 120 which creates and defines the distance between the post 105 and the mounting surface such as the wall. As depicted the separator arm 120 is perpendicular to the mounting surface. The separator arm 120, as depicted, is also perpendicular to the post 106. As shown, the post 106 is coupled to the arm 118 at one of the bends 110.

In one embodiment, the arm base 116 can rotate relative to the cover 101. Thus, in such an embodiment the cover 101 is stationary whereas the arm base 116 can rotate. When the arm base 116 rotates, so too does the arm 118. As can be seen, if the arm 118 is rotated 180 degrees, a top over the roll orientation, for example, will be converted to a behind the roll orientation. The arm 118 can be coupled to the arm base 116 via any method or device in the art. In one embodiment the arm 118 is coupled to the arm base 116 via a pin. In other embodiment the arm base 116 and the arm 118 can comprise a single integrally made piece.

In one embodiment the arm base 116 is biased relative to the cover 101. The arm base 116 can be biased via a spring or the like. In one embodiment the spring is located behind the knob 117. The spring biases the arm base 116 into a locked location relative to the cover 101 and/or the back plate 102. However, once the biased is released, such as by compressing the spring, the arm base 116 can rotate freely. In one embodiment releasing the arm base 116 requires an external force applied inwardly in the direction of the back plate 102. This allows the arm base 116 and the arm 118 to rotate.

In one embodiment there are at least two possible locations where the arm base 116 can lock into position. These positions can be achieved via any method or device known in the art. In one embodiment the device 100 has comprises voids or detents which secure the arm base 116 is a desired location, as will be discussed in more detail below. The arm base 116 can only be removed from these secure locations when an external force is applied. In other embodiments the arm base 116 will not have the voids, but the cover 101 or other coupling material will have voids which are received by the arm base 116. The voids reflect specific positions into which the arm base 116 will align. In one embodiment these two positions coincide with an over the top position and the roll orientation. In one embodiment these two positions are located about 180 degrees from one another.

In another embodiment there are at least three possible locations. These include the two positions described above as well as one location which is offset 90 degrees between the two positions. This allows for an upright and vertical dispensing orientation similar to that shown in FIG. 5.

In the embodiments depicted above there are finite possible locations and orientations of the arm base 116. In the three locations described above, in certain embodiments, there are six voids, two voids for each possible location. In other embodiments, however, there are infinite possible locations. In such embodiments there are not voids, but instead, the arm base 116 is maintained in the desired location by the biasing mechanism.

The biasing mechanism, such as a spring, can be adjusted depending upon the desired application. In one embodiment the biasing mechanism is sufficiently strong enough to maintain the arm 118 in the desired location, but not stiff enough that significant force is required to displace the arm base 116.

In one embodiment the force to displace the arm base 116 and allow rotation of the arm 118 relative to the stationary cover 101 can be applied by pressing inward upon the roll. Thus, if the user sees an over the top orientation and desires a behind the roll orientation, the user simply needs to push inward upon the roll, displacing the arm base 116 and then rotating the arm 118 180 degrees to the desired location. This change in orientation requires no external tools, and requires no assembly or disassembly, and can be completed without removing the roll from the holder.

FIG. 5 shows the post 106 as well as three grips 111 which extend outwardly from the post 106. The grips 111 provide tension on the roll. In one embodiment the grips 111 can be compressed by the roll.

Figure 6:
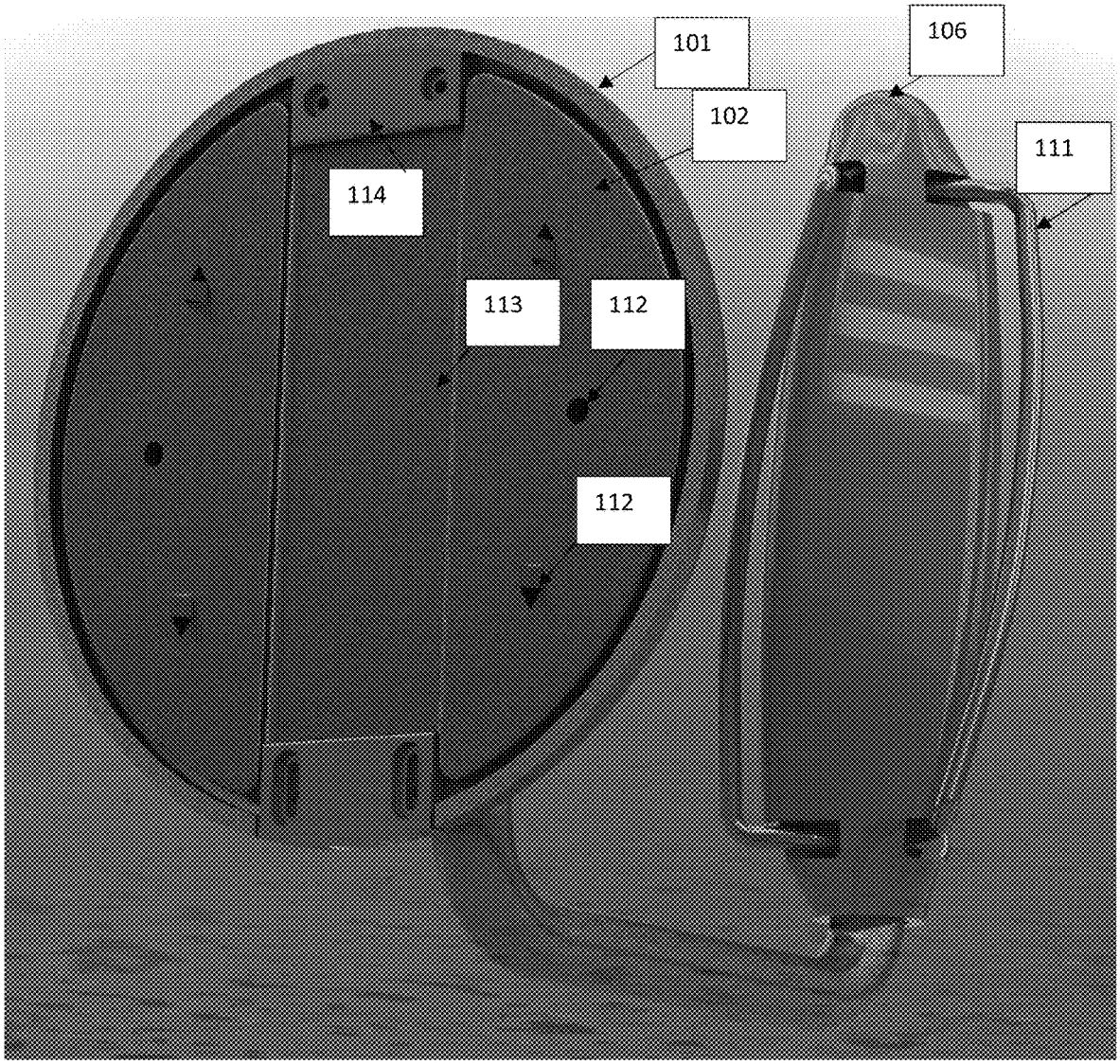
FIG. 6 is a rear perspective of the dispensing device in one embodiment.

Turning now to FIG. 6, FIG. 6 is a rear perspective of the dispensing device in one embodiment. As can be seen the black plate 102 has several mount holes 112 which can be secured to a mounting object such as a wall. The back plate 102 further includes spikes which grip and secure into the mounting object.

As depicted the cover 101 comprises a tab 114 which aligns with a channel 113 on the back plate 102. This allows the cover 101 to be securely coupled to the back plate 102. Set screws 103 can also be utilized, although in the embodiment depicted, no set screws are necessary. Due to the tab 114 and the channel 113 of the back plate, the cover 101 is maintained in its desired position relative to the back plate 102 even when a torque is applied to the arm 118. The tab 114 is maintained in its position by the channel 113.

Figure 7:
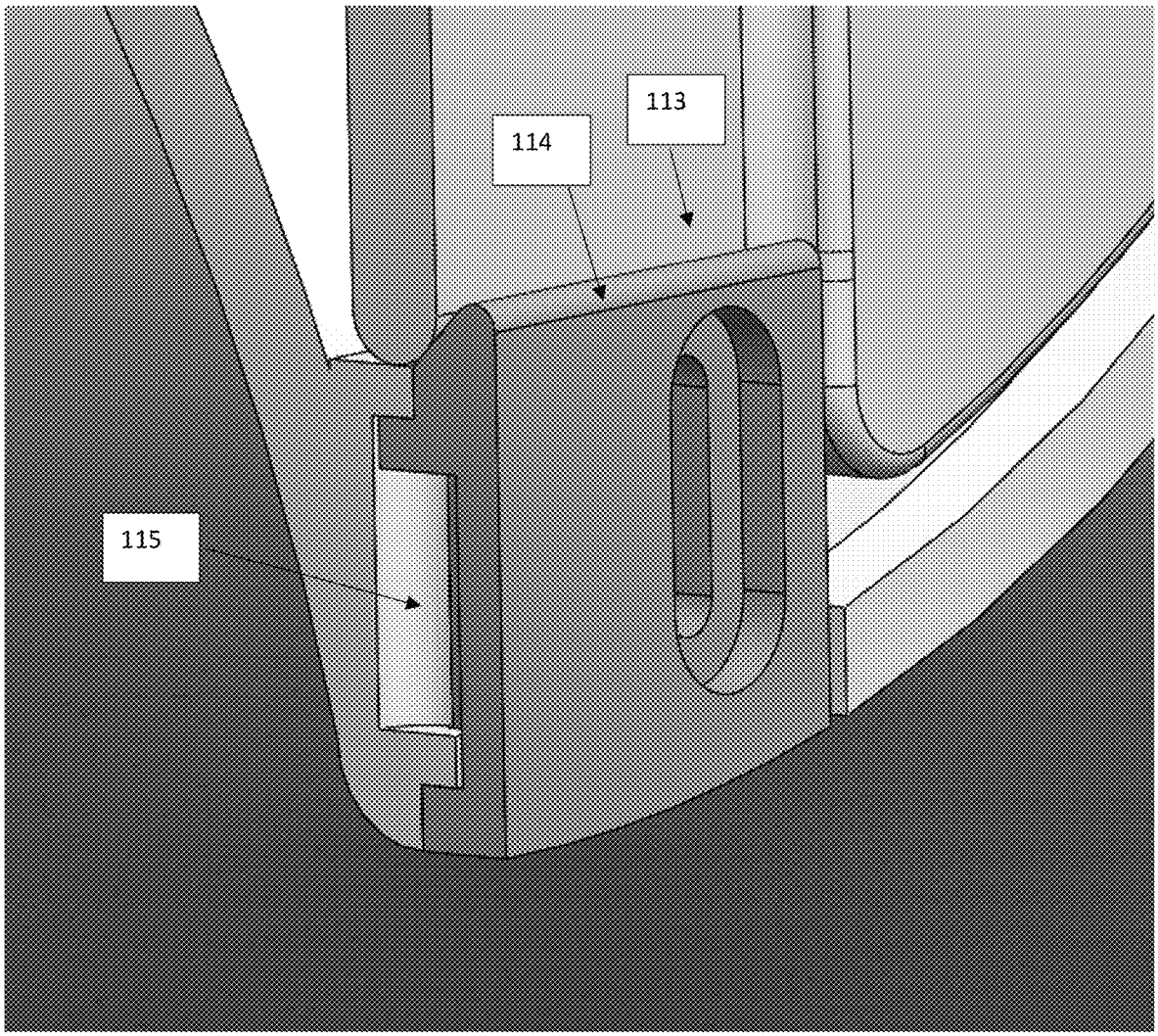
FIG. 7 is an enlarged perspective view of the spring channel.

Turning to FIG. 7, FIG. 7 is an enlarged perspective view of the spring channel. In this embodiment a spring channel 115 is used to hold a biasing mechanism such as a spring. This allows the depicted tab 114 to pivot and slide relative to the cover 101. This helps aid in installation. In one embodiment the cover 101 is simply friction fitted with the back plate 102 without the need for a set screw. Instead, the top portion of the cover can be slid on the back plate 102, and then the bottom portion, the portion with the spring channel 115 allows give which provides room to receive the bottom portion of the back plate 102 into the cover.

It should be noted that while one embodiment has been described wherein the cover 101 is stationary and the arm base 116 moves relative to the stationary cover 101, this is for illustrative purposes only. In other embodiments, for example, the back plate 102 is stationary and the cover 101 rotates relative to the back plate 102.

Figure 8A:
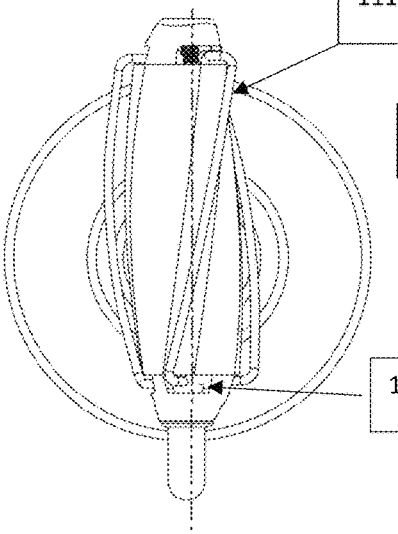
FIG. 8*a* is a top perspective view of the dispensing device in one embodiment.
Figure 8B:
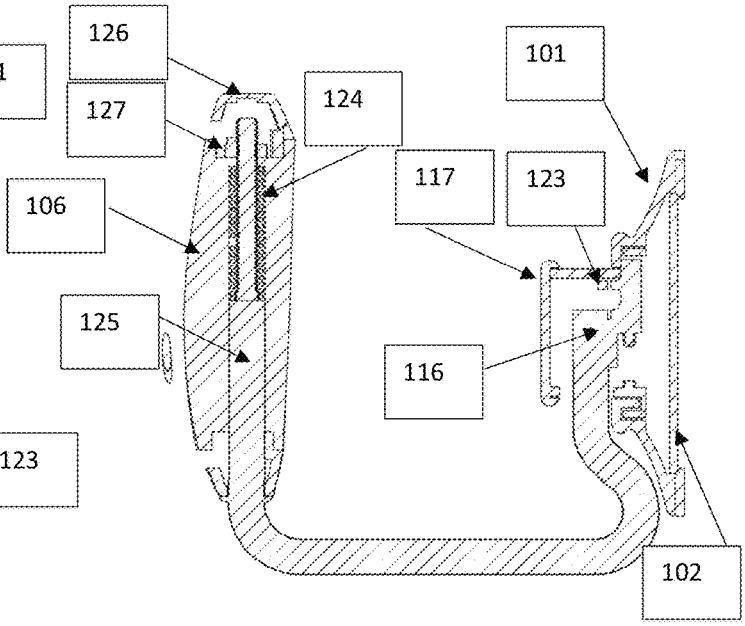
FIG. 8*b* is a side view of the dispensing device in FIG. 8*a;*

FIG. 8*a* is a top perspective view of the dispensing device in one embodiment, and FIG. 8*b* is a side view of the dispensing device in FIG. 8*a*. As can be seen, the post has three grips 111 which extend along the length of the post. As depicted, each of the grips 111 has a vortex shape meaning they rotate as they extend the length of the post. Thus, the top of the grips 111 are not vertically aligned, or in the same vertical plane, with the bottom. As all three grips 111 are rotated, the pressure they exert on the outer roll is constant along the length. This is contrasted with a paint roller, for example, wherein the pressure is increased at distinct points.

In one embodiment, and as depicted, the grips 111 do not have springs to provide tension. Instead, the grips 111 and their shape provide the necessary tension. As depicted the post 106 further includes grip slots 103 whereby the ends of the grips 111 can be received by the posts. The grip slots 103 also provide space for movement of the grips 111.

Turning to FIG. 8*b*, as shown the post 106 couples to the arm 116. As shown, the arm 116 has a portion which extends beyond the bend and couples to the post 106. This portion is referred to as the post arm 125. In one embodiment the post 106 slides down upon and surrounds the post arm 125. In one embodiment the post arm 125 has threads at its upper end which are coupled to a nut 127. A snap-on cap 126 covers the nut 127. In this fashion, the post arm 125 is coupled to the post 106.

As shown, within the post 106 is a friction spring 124. The friction spring 124 rubs and creates tension with the post arm 125. In so doing, the force required to rotate the post 106 is slightly increased. The prevents unintentional and accidental unraveling of the toilet paper roll, for example. Because some minimal force is required to rotate the post 106 to dispense paper, the accidental unraveling of an entire toilet paper roll is reduced. Further, the back force allows a user to pull and tear toilet paper with one hand rather than having one hand secure the roll and one hand on the free end of the toilet paper. Thus, the friction spring 124 has many benefits not found in prior art toilet paper rolls.

Figure 9:
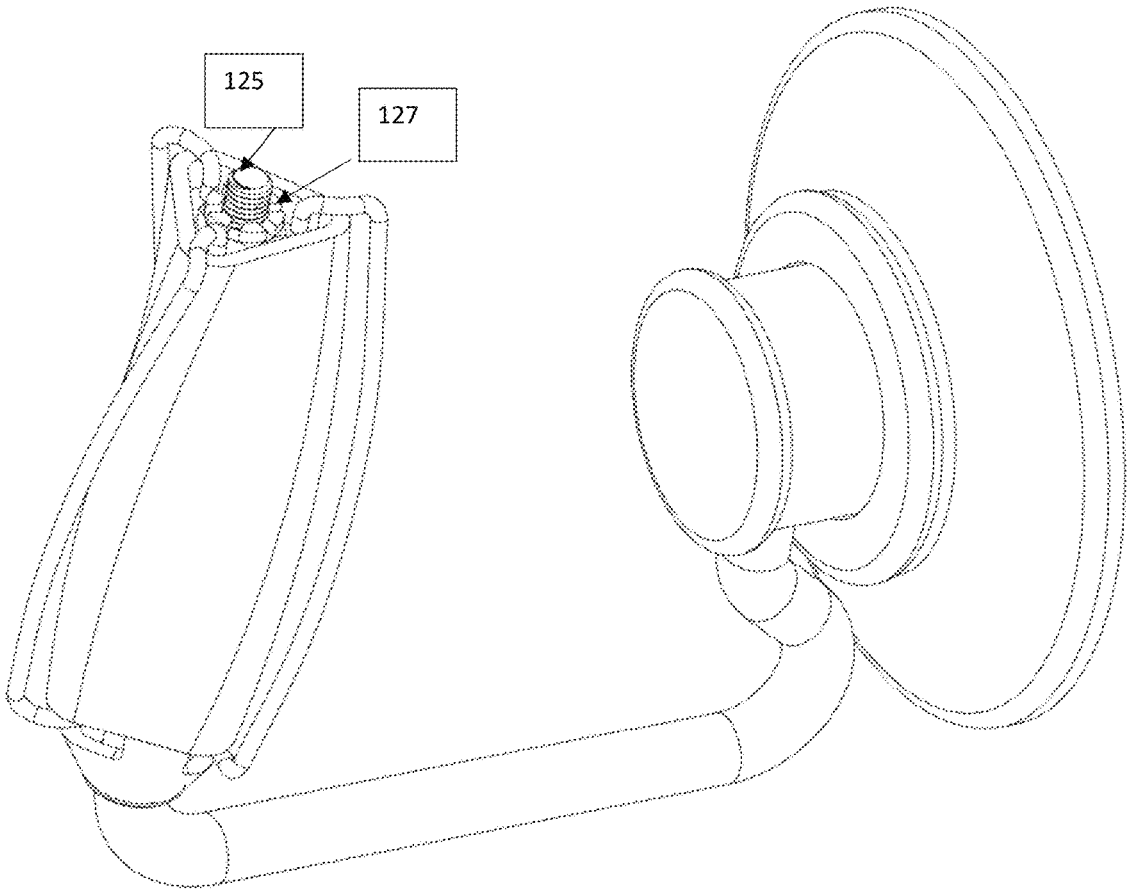
FIG. 9 is a perspective view of the dispensing device in one embodiment.

FIG. 9 is a perspective view of the dispensing device in one embodiment. As can be seen, the nut 127 is coupled to the threaded upper portion of the post arm 125. In one embodiment the nut 127 is coupled to the post 106. The cap 126 has been removed to show the exposed nut 127 and post arm 125. In other embodiments, however, the cap 126 is placed so that the nut is not visible.

Figure 10:
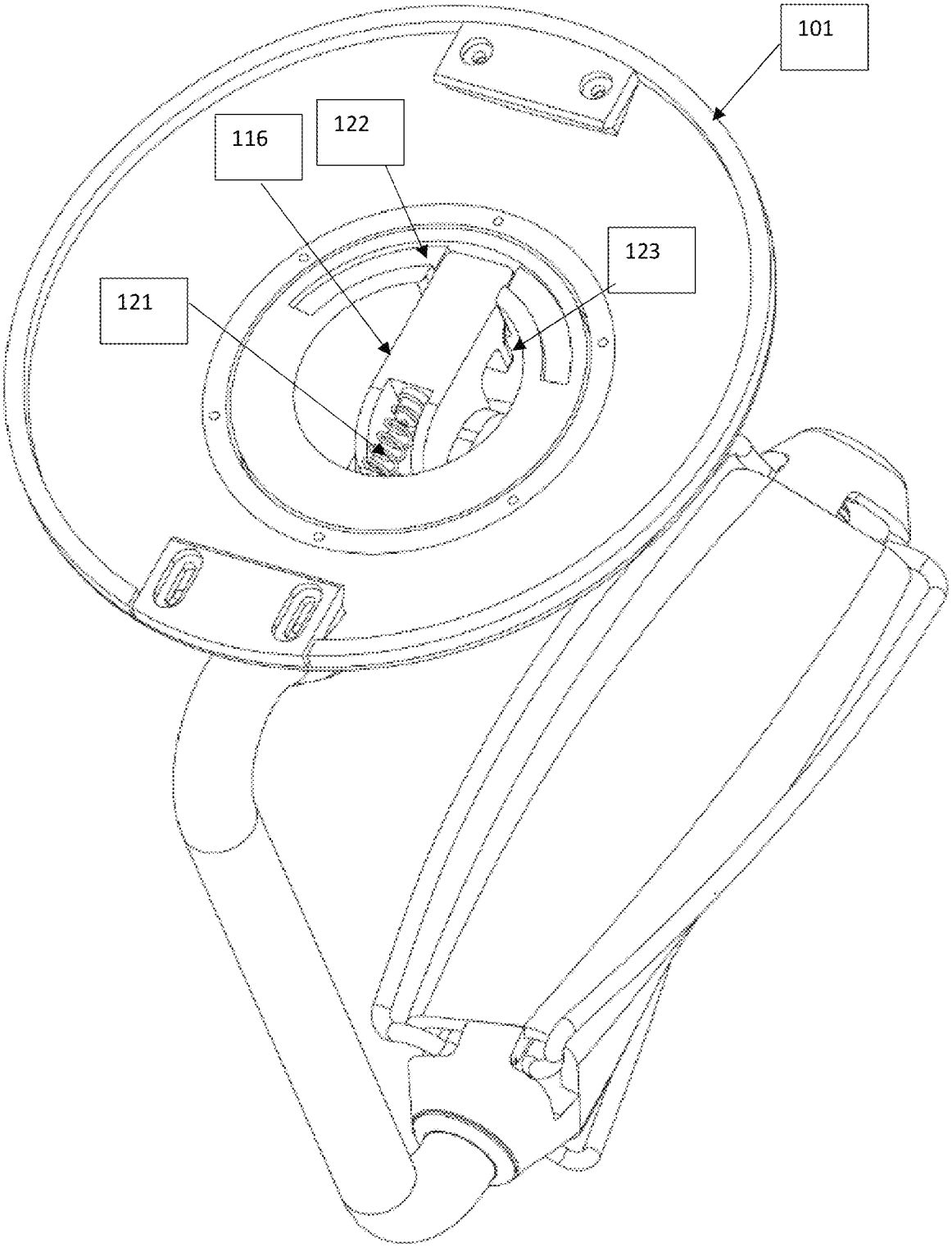
FIG. 10 is a back-perspective view of the dispensing device in one embodiment.

FIG. 10 is a back-perspective view of the dispensing device in one embodiment. As discussed, there are many ways in which the arm base 116 is rotatable relative to the cover 101. FIG. 10 illustrates one possible way of implementing this, but this is for illustrative purposes only and should not be deemed limiting. As shown the arm base 116 is urged forward relative to the spring 121. Thus, as depicted, the arm base 116 is urged downward in the illustration. When the user applies a counter acting force the spring 121 is compressed and the arm base 116 is urged upward. At this point, the tongue 123 which is coupled to the arm base 116 also moves upward and unseats itself from the below seat. While not depicted, below the tongue 123 is a ring which has a series of stops. The stops have a series of voids or recesses which receive the tongue 123 and lock the tongue 123, and thus the arm base 116 into that location. If the device 100 has three possible stops, then the ring will have three recesses to receive the tongue 123 in the various positions.

As shown, the arm plate 122 is coupled to the arm base 116 such that when the arm base 115 rotates, so too does the arm plate 122. The arm plate 122 serves to stabilize and offer support to the arm base 116.

Now that the system has been described a method of converting roll orientations of a dispensing apparatus will be discussed. As noted, the system, in one embodiment comprises a back plate coupled to a cove, an arm base coupled to an arm, and the arm coupled to a post. In one embodiment the arm base can rotate relative to the cover. The method comprises beginning at a first orientation. The orientation can be either a vertical orientation, an over-the-top orientation wherein the toilet paper free end falls over the roll closer to the user, or the behind-the-roll orientation wherein the free end falls behind the roll further from the user. The user then applies a force either directly to the arm base or arm or to an item coupled to the arm such as the roll. Thereafter, the arm is rotated to a second orientation. In one embodiment the arm is rotated 180 degrees. Thus, if the first orientation is an over-the-top orientation, the second orientation will be the behind-the-roll orientation. No tools are necessary for this conversion. Furthermore, the roll does not need to be removed. Instead, a force is applied which allows the arm to rotate.

As noted, the system and method has many advantages. First, it allows a roll to be dispensed using a single post with a single point of contact. This is beneficial because it eases installation. Rather than having two opposing points of contact, this allows for installation of a single post. Because a single post is used, the device can be installed in locations previously unavailable. Further, because a single post is utilized, the device can be installed in a vertical position which was previously unavailable if two points of contact were required. The vertical installation further decreases the likelihood of accidental unrolling.

Another benefit, discussed above, is the ability to quickly transition from an over to an under dispensing arrangement. When the user had to decouple both ends, and reinstall, often the user simply waited until the roll was empty to make the transition from over to under, or vice versa. Now, however, the transition simply requires decoupling one end. This allows the user to couple and decouple, and transition between dispensing positions, quickly and easily.

Finally, as noted, due to the spring, bearing, and/or coupling the post to the tube both prevent accidental unwinding of the roll. This reduces wasting of paper and the need to clean up the wasted toilet paper.

While the invention has been particularly shown and described with reference to a preferred embodiment, it will be understood by those skilled in the art that various changes in form and detail may be made therein without departing from the spirit and scope of the invention.

What is claimed is:

1. A system for dispensing toilet paper, said system comprising:

a back plate coupled to a cover;

an arm base coupled to an arm;

wherein said arm is coupled to a post;

wherein said arm base can rotate relative to said cover;

wherein said arm comprises a post arm which couples to said post, wherein a portion of said post arm comprises threading, and wherein said post further comprises a nut to couple with said threading on said post arm.

2. The system of claim 1 wherein said arm comprises a separator arm portion with a bend at each end, and a post arm which couples to said post.

3. The system of claim 2 wherein said separator arm portion is perpendicular to said back plate.

4. The system of claim 1 wherein said post further comprises at least three grips.

5. The system of claim 4 wherein at least three grips comprise a vortex shape around a length of said post.

6. The system of claim 1 wherein said post further comprises a friction spring to increase rotational friction.

7. The system of claim 1 further comprising a spring to bias said arm base.

8. The system of claim 7 wherein said arm base further comprises a tongue, and wherein said system further comprises a component which has at least two voids to receive said tongue.

9. The system of claim 7 wherein by applying a force to counteract said spring, said arm can be rotated relative to said back plate.

10. The system of claim 9 comprising at least two possible locations wherein said arm base can be locked in place.

11. The system of claim 10 wherein at least two of said possible locations are located 180 degrees from one another.

12. The system of claim 9 comprising three possible locations wherein said arm base can be locked in place.

13. The system of claim 9 wherein said arm can rotate without any external tools.

14. The system of claim 9 further comprising a roll of toilet paper coupled to said post, and wherein a first position comprises an over-the-top roll configuration and wherein a second position comprises a behind-the-roll configuration, and wherein the two positions can be achieved by rotating the arm.

* * * * *